US006110628A

United States Patent [19]

Sekiya et al.

[11] Patent Number: 6,110,628

[45] Date of Patent: Aug. 29, 2000

[54] ELECTROPHOTOGRAPHIC PHOTOSENSITIVE MEMBER, PROCESS CARTRIDGE, AND ELECTROPHOTOGRAPHIC APPARATUS

[75] Inventors: Michiyo Sekiya, Mishima; Hideki Anayama, Yokohama; Akio Maruyama, Tokyo; Shoji Amamiya, Numazu; Hiroki Uematsu, Numazu; Hiroyuki Tanaka, Numazu, all of Japan

[73] Assignee: Canon Kabushiki Kaisha, Tokyo, Japan

[21] Appl. No.: 09/126,852

[22] Filed: Jul. 31, 1998

[30] Foreign Application Priority Data

| | | | |
|---|---|---|---|
| Aug. 1, 1997 | [JP] | Japan | 9-207725 |
| Oct. 6, 1997 | [JP] | Japan | 9-272579 |
| Oct. 6, 1997 | [JP] | Japan | 9-272580 |

[51] Int. Cl.[7] ..... G03G 5/147; G03G 5/05

[52] U.S. Cl. ..... 430/66; 430/58.05; 430/96; 430/67; 399/116; 399/159

[58] Field of Search ..... 430/58.05, 59.6, 430/66, 96, 67; 399/116, 159

[56] References Cited

U.S. PATENT DOCUMENTS

| | | | |
|---|---|---|---|
| 4,551,403 | 11/1985 | Miyakawa et al. | 430/59.6 |
| 4,851,314 | 7/1989 | Yoshihara | 430/58.05 |
| 5,352,552 | 10/1994 | Maruyama et al. | 430/18 |
| 5,399,452 | 3/1995 | Takegawa et al. | 430/59.6 |
| 5,418,099 | 5/1995 | Mayama et al. | 430/58 |
| 5,455,135 | 10/1995 | Maruyama et al. | 430/58 |
| 5,538,826 | 7/1996 | Ainoya et al. | 430/59.6 |
| 5,558,964 | 9/1996 | Yoshihara et al. | 430/58 |
| 5,585,214 | 12/1996 | Kashimura et al. | 430/96 |
| 5,693,443 | 12/1997 | Nakamura et al. | 430/66 |
| 5,725,982 | 3/1998 | Nogami et al. | 430/66 |
| 5,747,203 | 5/1998 | Nozomi et al. | 430/59.6 |
| 5,800,955 | 9/1998 | Kashimura et al. | 430/58 |

OTHER PUBLICATIONS

Grant, Roger et al. Grant and Hackh's Chemical Dictionary. New York: McGraw–Hill, Inc. p. 502, "repeating unit", 1987.

*Primary Examiner*—Christopher D. Rodee

*Attorney, Agent, or Firm*—Fitzpatrick, Cella, Harper & Scinto

[57] ABSTRACT

An electrophotographic photosensitive member is comprised of a support and a photosensitive layer formed on the support. The electrophotographic photosensitive member has a surface layer which contains a resin having at least one of the structural units represented by the following formula:

wherein the bond represented by a broken line may be present, and when present, m is 4 and when m is 6, n represents an integer of 0 or more, and $R_1$ and $R_2$ represent each independently hydrogen, halogen, hydroxy, a substituted or unsubstituted alkyl, a substituted or unsubstituted unsaturated aliphatic hydrocarbon, a substituted or unsubstituted aryl, a substituted or unsubstituted cycloalkyl, a substituted or unsubstituted cyclodienyl, a substituted or unsubstituted alkoxy, a substituted or unsubstituted carbonyl, or a substituted or unsubstituted heterocyclic group.

17 Claims, 1 Drawing Sheet

FIGURE
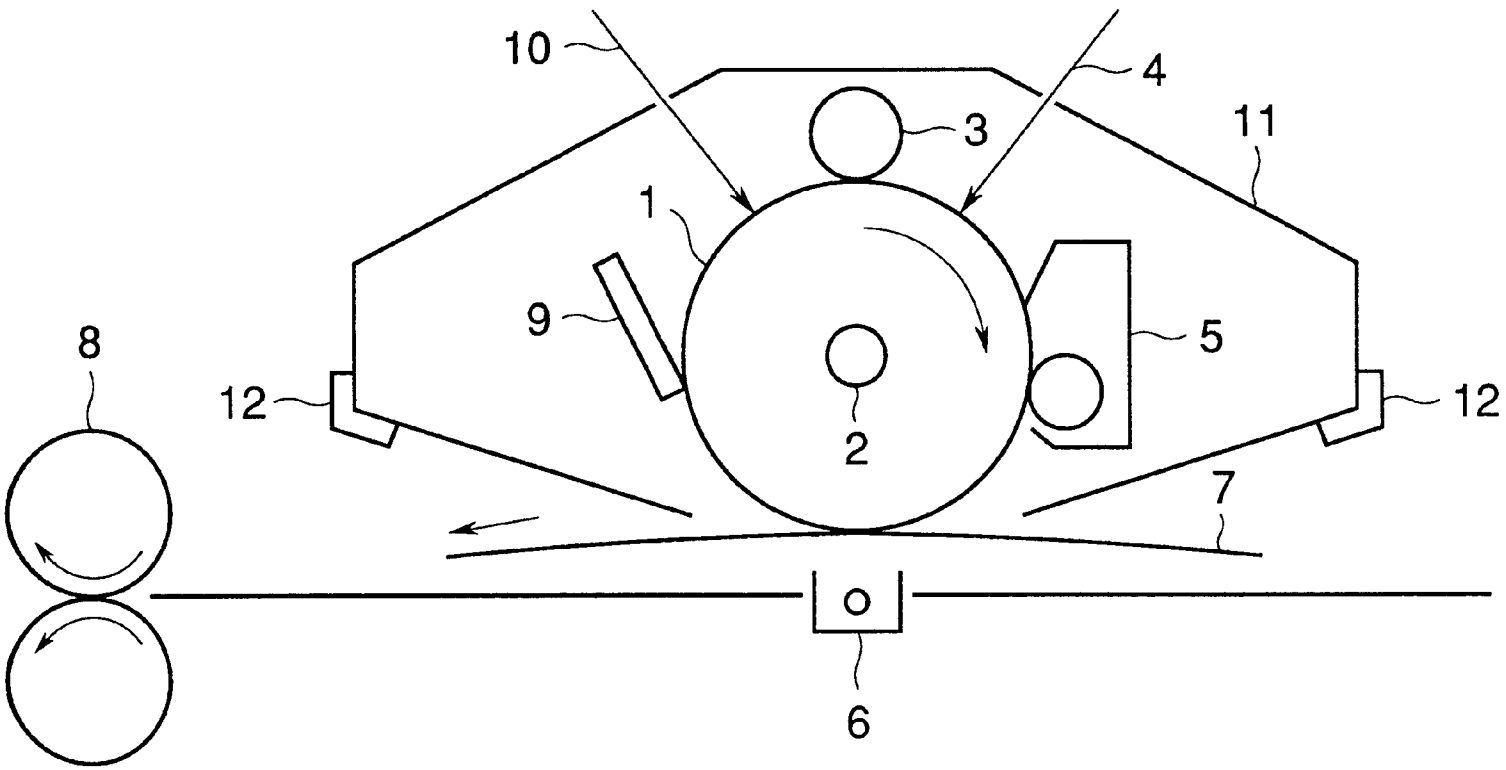

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

This invention relates to an electrophotographic photosensitive member, a process cartridge and an electrophotographic apparatus which have the electrophotographic photosensitive member. More particularly, it relates to an electrophotographic photosensitive member having a surface layer containing a resin with a specific structure, and a process cartridge and an electrophotographic apparatus which have such an electrophotographic photosensitive member.

2. Related Background Art

Inorganic materials such as selenium, cadmium sulfide and zinc oxide are conventionally known as photoconductive materials used in electrophotographic photosensitive members. In contrast, organic materials including polyvinyl carbazole, phthalocyanine and azo pigments have attracted attention due to the advantages that they promise, such as high productivity and no environmental pollution. They have been put into wide use although they tend to be inferior to the inorganic materials in photoconductive performance or running performance.

Meanwhile, electrophotographic photosensitive members are required to be durable against various external physical, chemical and electrical forces, since they are repeatedly affected by charging, exposure, development, transfer, cleaning and charge elimination in electrophotographic processes in copying machines or laser beam printers. In particular, the surface layer of the photosensitive member, i.e., the layer most distant from the support is required to have durability to surface wear and scratching which are caused by, e.g., rubbing, and is also required to be durable against surface deterioration caused by charging.

In image forming apparatus of an electrophotographic system, corona charging assemblies have been used as means for electrostatically charging the electrophotographic photosensitive member. In this system, corona products such as ozone and nitrogen oxides are formed when corona occurs, and this accelerates the deterioration of the photosensitive member's surface.

In recent years, because of low ozone and low power consumption, apparatus are used in which the photosensitive member is charged by applying a voltage to a charging member coming in contact with the photosensitive member, i.e., a contact charging assembly. Specifically, the photosensitive member is charged by the discharge caused at a minute gap between the charging member and the photosensitive member by applying a voltage of about 1 to 2 kV between the charging member and the photosensitive member.

However, in the system where only a DC voltage is applied to the charging member, the resistivity of the charging member may vary depending on variations of the temperature and humidity that surround the apparatus. Also, the electrostatic capacity of the photosensitive member may vary as a result of a change in layer thickness caused by scrape because of repeated use. Hence, it is difficult to keep the surface potential of the photosensitive member at the desired value.

Accordingly, in order to achieve the uniformity of charging, a method is used in which an AC voltage having a peak-to-peak voltage at least twice the discharge threshold voltage is superimposed on the DC voltage corresponding to the desired charging voltage.

However, even the contact charging produces ozone in a very small quantity. Since the discharge takes place in the vicinity of the photosensitive member, the damage to the photosensitive member is much greater than that caused by the corona discharge. This damage is even greater when the system of superimposing AC voltage is used. Thus, the surface layer deterioration due to charging has more and more influence.

As stated above, the properties required for the surface layer are specifically exemplified by chemical resistance to ozone and nitrogen oxides occurring at the time of charging, electrical resistance to discharge, and mechanical strength against rubbing in, for example, cleaning. The scrape occurring in the contact charging system is so conspicuous that the surface deterioration caused by charging may have a substantial influence, and an improvement in these properties is sought.

SUMMARY OF THE INVENTION

An object of the present invention is to provide an electrophotographic photosensitive member that has a superior mechanical strength and also have a superior electrical and chemical resistance to charging, a process cartridge and an electrophotographic apparatus which have such an electrophotographic photosensitive member.

That is, the present invention provides an electrophotographic photosensitive member comprising a support and a photosensitive layer formed on the support, wherein the electrophotographic photosensitive member has a surface layer containing a resin having at least one of structural units represented by Formulas (1) and (2):

(1)

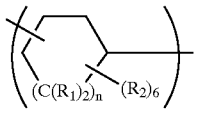

wherein n represents an integer of 0 or more; $R_1$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted or unsubstituted carbonyl group or a substituted or unsubstituted heterocyclic group; and $R_2$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted or unsubstituted carbonyl group or a substituted or unsubstituted heterocyclic group;

(2)

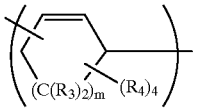

wherein m represents an integer of 0 or more; $R_3$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted or unsubstituted carbonyl group or a substituted or unsubstituted heterocyclic group; and $R_4$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted or unsubstituted carbonyl group or a substituted or unsubstituted heterocyclic group.

The present invention also provides a process cartridge and an electrophotographic apparatus which have the electrophotographic photosensitive member described above.

BRIEF DESCRIPTION OF THE DRAWING

FIGURE schematically illustrates an example of the construction of an electrophotographic apparatus provided with a process cartridge having the electrophotographic photosensitive member of the present invention.

DESCRIPTION OF THE PREFERRED EMBODIMENTS

The surface layer of the electrophotographic photosensitive member of the present invention contains a resin having at least one of structural units represented by the following Formulas (1) and (2):

(1)

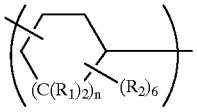

wherein n represents an integer of 0 or more; $R_1$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted or unsubstituted carbonyl group or a substituted or unsubstituted heterocyclic group; and $R_2$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted or unsubstituted carbonyl group or a substituted or unsubstituted heterocyclic group;

(2)

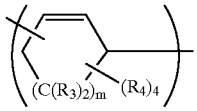

wherein m represents an integer of 0 or more; $R_3$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted or unsubstituted carbonyl group or a substituted or unsubstituted heterocyclic group; and $R_4$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted or unsubstituted carbonyl group or a substituted or unsubstituted heterocyclic group.

The resin having the specific structure, used in the present invention, has a relatively high glass transition temperature (Tg) of about 150° C. or above, and hence is presumed to contribute to a superior mechanical strength and also to have a structure that may hardly bring about, for some reasons, molecular break due to electrical or chemical deterioration caused by charging.

The letters n and m in Formulas (1) and (2), respectively, may preferably be each from 1 to 4, and more preferably 2, in view of readiness for synthesis.

In addition, when n and m are each 0, the central skeletons are 4-membered rings, and when m=n=2, 2, the central skeletons are 6-membered rings.

In Formulas (1) and (2), the halogen atom represented by $R_1$ to $R_4$ may include a fluorine atom, a chlorine atom and a bromine atom; the alkyl group, a methyl group, an ethyl group, a propyl group, an isopropyl group and a butyl group; the unsaturated aliphatic hydrocarbon group, an ethenyl group, an isopropenyl group, a butenyl group and a butadienyl group; the aryl group, a phenyl group and a naphthyl group; the cycloalkyl group, a cyclohexyl group and a cycloheptyl group; the cyclodienyl group, a cyclopentadienyl group and a cyclohexadienyl group; the alkoxyl group, a methoxyl group, an ethoxyl group and a propoxyl group; the carbonyl group, an aldehyde group, an acetyl group and an isobutyryl group; and the heterocyclic group, a pyridyl group, a pyranyl group and a thiazolyl group.

The substituents of the above alkyl group, unsaturated aliphatic hydrocarbon group, aryl group, cycloalkyl group, cyclodienyl group, alkoxyl group, carbonyl group and heterocyclic group include halogen atoms such as a fluorine atom, a chlorine atom and a bromine atom; a hydroxyl group; alkyl groups such as a methyl group, an ethyl group, a propyl group, an isopropyl group and a butyl group; unsaturated aliphatic hydrocarbon groups such as an ethenyl group, an isopropenyl group, a butenyl group and a butadienyl group; aryl groups such as a phenyl group and a naphthyl group; cycloalkyl groups such as a cyclohexyl group and a cycloheptyl group; cyclodienyl groups such as a cyclopentadienyl group and a cyclohexadienyl group; alkoxyl groups such as a methoxyl group, an ethoxyl group and a propoxyl group; carbonyl groups such as an aldehyde group, an acetyl group and an isobutyryl group; and heterocyclic groups such as a pyridyl group, a pyranyl group and a thiazolyl group.

Of these, all of $R_1$ to $R_4$ may preferably be hydrogen atoms, because of especially superior resistance to electrical deterioration and chemical deterioration.

Preferred examples of the structural unit represented by Formula (1) are specifically shown below. Examples are by no means limited to these.

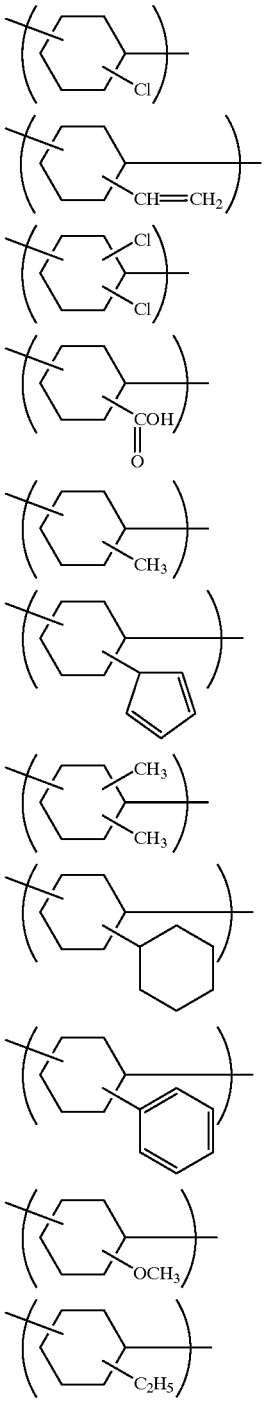

-continued

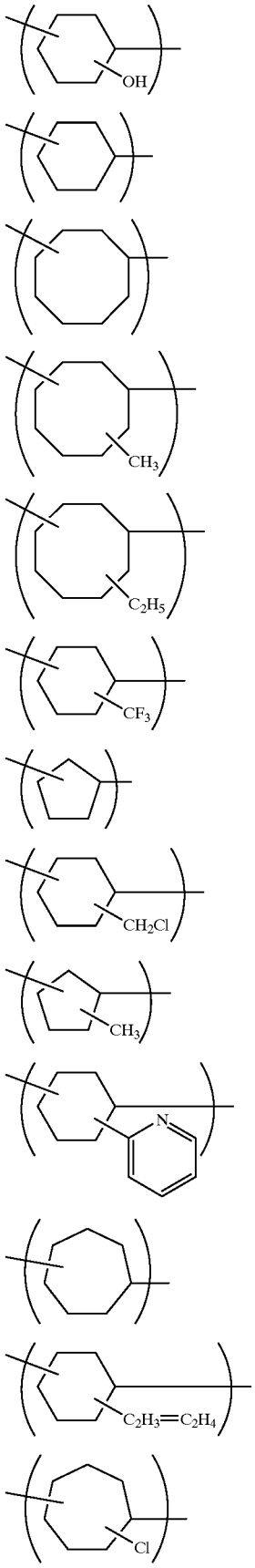

-continued
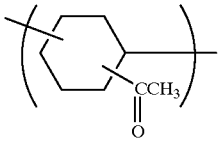
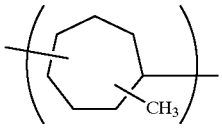
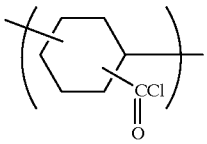
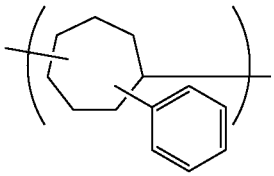
Preferred examples of the structural unit represented by Formula (2) are specifically shown below. Examples are by no means limited to these.
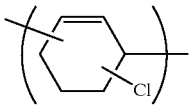
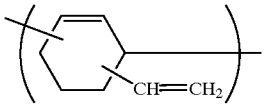
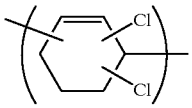
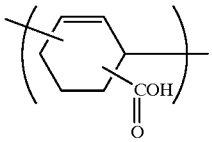
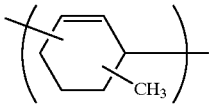
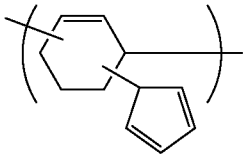
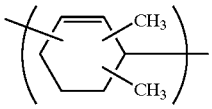
-continued
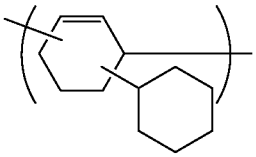
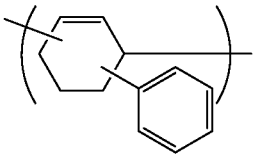
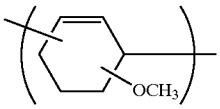
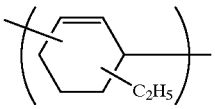
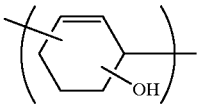
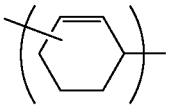
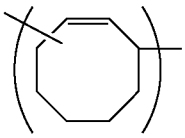
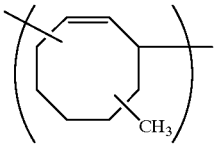
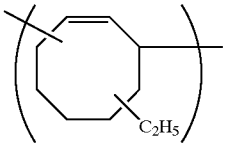
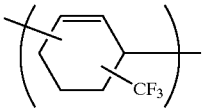
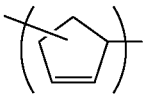
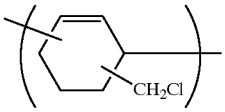
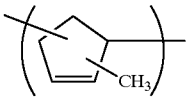

-continued

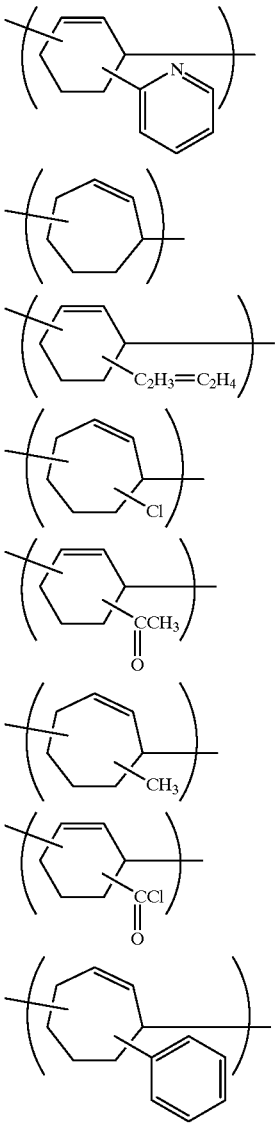

The resin used in the present invention may have both structural units represented by Formulas (1) and (2). When the resin of the present invention is synthesized by the method described in the undermentioned Synthesis Examples, it tends to have both structural units represented by Formulas (1) and (2).

The resin of the present invention may also have a structural unit other than the structural units represented by Formulas (1) and (2).

Monomers that can derive such a structural unit may include units such as 1,3-butadiene, isoprene, 2,3-diemthyl-1,3-butadiene, 1,3-pentadiene, 1,3-hexadiene, ethylene, styrene, α-methylstyrene, o-methylstyrene, p-methylstyrene, p-tert-butylstyrene, α,β-dimethylstyrene, divinylbenzene, vinylnaphthalene, vinylanthracene, 1,1-diphenylethylene, m-diisopropenylbenzene, vinylpyridine, methyl methacrylate, methyl acrylate, acrylonitrile, methyl vinyl ketone, methyl α-cyanoacrylate, ethylene oxide, propylene oxide, cyclic lactone, cyclic lactam and cyclic siloxane, and units derived from any of the above.

The structural units represented by Formulas (1) and (2) may preferably be each in an amount from 40 to 100 mol %, and particularly from 70 to 100 mol %, of all the structural units. If they are each present in an amount less than 40 mol %, the meritorious effects of the present invention are hard to attain.

In the present invention, it is preferred that the structural units represented by Formulas (1) and (2) are each linked in series. Specifically, it is preferred that 5 or more units are linked in series. In particular, a chain of 10 or more units is preferable.

The resin of the present invention may have any molecular weight so long as a viscosity can be attained which can provide a preferable layer thickness when the photosensitive layer is formed by coating. In view of the mechanical strength of the resultant layer, the resin may preferably have a weight-average molecular weight from 10,000 to 100,000, and particularly from 20,000 to 80,000.

In the present invention, the surface layer may further contain a polymer or resin other than the resin in the present invention. Such a polymer or resin may include conventionally known thermoplastic resins and curable resins.

Examples of the thermoplastic resins are polyethylene (PE), an ethylene-norbornene (or its derivative) copolymer, polypropylene (PP), an ethylene-propylene copolymer (EP or EPR), an ethylene-propylene-diene copolymer (EPDM), poly-1-butene, poly-1-pentene, poly-1-hexene, poly-1-octene, polyisobutylene, polymethyl-1-butene and poly-4-methyl-1-pentene; polystyrene (PSt), syndiotactic polystyrene (s-PSt), a styrene-acrylic acid copolymer, a styrene-maleic anhydride copolymer (SMA), ABS resin and AES resin; polybutadiene (PBd) and polyisoprene (PIp); block, graft, or random copolymers such as a butadiene-isoprene copolymer, a styrene-butadiene copolymer (SB or SBS), a propylene-butadiene copolymer, a styrene-isoprene copolymer (SI or SIS), an α-methylstyrene-butadiene copolymer, an α-methylstyrene-isoprene copolymer, an acrylonitrile-butadiene copolymer, an acrylonitrile-isoprene copolymer, a butadiene-methyl methacrylate copolymer and an isoprene-methyl methacrylate copolymer, as well as their hydrogenated polymers (e.g., SEBS); polymethyl acrylate or methacrylate (PMMA), polyethyl acrylate or methacrylate and polybutyl acrylate or methacrylate; polyacryl- or methacrylamide; polyacrylo- or methacrylonitrile; polyvinyl halides and polyvinylidene halides; polybutylene terephthalate (PBT), polyethylene terephthalate (PET), polycarbonate (PC), polyarlates (PAR), and liquid-crystal polyesters (LCP); polyacetals (POM), polyoxyethylene, polyethylene glycol (PEG), polypropylene glycol (PPG) and polyphenylene ether (PPE); aliphatic polyamides such as nylon 4, nylon 6, nylon 8, nylon 9, nylon 10, nylon 11, nylon 12, nylon 46, nylon 66, nylon 610, nylon 612, nylon 636 and nylon 1212; nylon 4T (T: terephthalic acid), nylon 4I (T: isophthalic acid), nylon 6T, nylon 6I, nylon 12T, nylon 121 and nylon MXD6 (MXD: methaxylenediamine); polyimide (PI), polyamide-imide (PAI) and polyether-imide (PEI); polyphenylene sulfide (PPS); polysulfone (PSF) and polyether sulfone (PES); and polyether ketone (PEK) and polyether ether ketone (PEEK).

Examples of the curable resins include unsaturated polyesters such as a polydiallyl phthalate-phenol-formaldehyde copolymer, urea resins such as urea-formaldehyde, melamine resins such as polyallylmelamine and a melamine-formaldehyde copolymer, urethane resins, and phenol resins such as a phenol-formaldehyde copolymer.

The resin of the present invention may preferably be in an amount of 20% by weight or more, and particularly 50% by weight or more, based on the total weight of the resins used. If it is present in an amount less than 20% by weight, the meritorious effects of the present invention are difficult to attain.

The photosensitive layer of the present invention may be either of what is called a single-layer type, in which a charge-generating material and a charge-transporting material are contained in the same layer, and what is called a multi-layer type, which is functionally separated into a charge generation layer containing a charge-generating material and a charge transport layer containing a charge-transporting material. The multi-layer type is preferred. It is more preferred that the charge transport layer is provided on the charge generation layer.

The support may be any of those having conductivity, and may, for example, be obtained by molding metals or alloys (such as aluminum, copper, chromium, nickel, zinc and stainless steel) into drums or sheets, laminating metal foil of aluminum or copper onto plastic films, vacuum-deposition of aluminum, indium oxide or tin oxide onto plastic films, and metals, plastic films or paper onto which a conductive material is applied alone or in combination with a binder resin to provide a conductive layer.

The charge generation layer may be formed by i) coating of a dispersion prepared by dispersing a charge-generating material such as an azo pigment, a quinone pigment (e.g., pyrenequinone and anthanthrone), a quinocyanine pigment, a perylene pigment, an indigo pigment (e.g., indigo or thioindigo) or a phthalocyanine pigment in a binder resin such as polyvinyl butyral, polystyrene, polyvinyl acetate or acrylic resin, or ii) vacuum-deposition of these pigments. The charge generation layer may preferably have a layer thickness of 5 $\mu$m or less, and more preferably from 0.05 to 3 $\mu$m.

The charge-transporting material contained in the charge transport layer may include triarylamine compounds, hydrazone compounds, stilbene compounds, pyrazoline compounds, oxadiazole compounds, thiazole compounds and triarylmethane compounds. Since the charge-generating materials commonly have poor film-forming properties, they are dissolved in a suitable resins and put into use. The resins of the present invention having the specific structure is used when the charge transport layer is the surface layer of the photosensitive member. When it is not the surface layer, other resin may be used. Such other resin may be the same as those previously described.

The charge transport layer may be formed by coating of a solution prepared by dissolving the above charge-generating material and resins using a suitable solvent, and drying the coating formed. The resin may preferably be in an amount from 20 to 80% by weight, and more preferably from 30 to 60% by weight, based on the total solid content of the charge transport layer. The charge transport layer may preferably have a layer thickness from 5 to 40 $\mu$m, and more preferably from 10 to 30 $\mu$m.

The single-layer type photosensitive layer may be formed by coating of a solution prepared by dispersing and dissolving in a resin the charge-generating material described above and the charge-transporting material described above, and drying the coating formed. As the resin, at least the resin of the present invention having the specific structure is used when the photosensitive layer is the surface layer. When it is not the surface layer, other resin may be used without using the resin of the present invention having the specific structure. Such other resin may be the same as those previously described. The photosensitive layer may have a layer thickness from 5 to 40 $\mu$m, and more preferably from 10 to 30 $\mu$m.

In the present invention, a protective layer may be provided on the photosensitive layer. The protective layer contains at least the resin of the present invention having the specific structure, and may further contain other resin. Such other resin may be the same as those previously described. The protective layer may be formed using the resin alone. Alternatively, for the purpose of reducing residual potential, there may be added the charge-transporting material described above or a conductive material such as conductive powder. The conductive powder may include metal powders, scaly metal powders or metal short fibers of aluminum, copper, nickel and silver, conductive metal oxides such as antimony oxides, indium oxides and tin oxides, polymeric conductive materials such as polypyrrole, polyaniline and polyelectrolytes, carbon black, carbon fiber, graphite powder, organic or inorganic electrolytes, and conductive powders whose particle surfaces are coated with any of these conductive materials. The protective layer may preferably have a layer thickness of from 0.2 to 15 $\mu$m, and more preferably from 0.5 to 15 $\mu$m, which depends on electrophotographic performance and durability (or running performance).

A subbing layer functioning as a barrier and an adhesive may be provided between the support and the photosensitive layer. The subbing layer may be formed out of casein, polyvinyl alcohol, nitrocellulose, an ethylene-acrylic acid copolymer, an alcohol-soluble amide, polyurethane or gelatin. The subbing layer may preferably have a layer thickness from 0.1 to 3 $\mu$m.

FIGURE schematically illustrates the construction of an electrophotographic apparatus having a process cartridge having the electrophotographic photosensitive member of the present invention.

In FIGURE, reference numeral 1 denotes a drum type electrophotographic photosensitive member of the present invention, which is rotatively driven around an axis 2 in the direction of an arrow at a given peripheral speed. The photosensitive member 1 is uniformly electrostatically charged on its periphery to be positive or negative, by a potential supplied through a primary charging means 3. The photosensitive member thus charged is then photo image-like exposed to light 4 emitted from an image-like exposing means (not shown) for slit exposure or laser beam scanning exposure. In this way, electrostatic latent images are successively formed on the periphery of the photosensitive member 1.

The electrostatic latent images thus formed are subsequently developed by toner by the operation of a developing means 5. The resulting toner-developed images are then successively transferred by the operation of a transfer means 6, to the surface of a transfer medium 7 fed from a paper feed section (not shown) between the photosensitive member 1 and the transfer means 6 while synchronized with the rotation of the photosensitive member 1.

The transfer medium 7 onto which the images have been transferred is separated from the surface of the photosensitive member, led through an image fixing means 8, where the images are fixed, and then printed out of as a copy.

The remaining toner on the surface of the photosensitive member 1 from which images have been transferred is removed by a cleaning means 9. Thus the cleaned photosensitive member surface is, further subjected to charge elimination by pre-exposure light 10 emitted from a pre-exposure means (not shown), and then repeatedly used for the image formation. When the primary charging means is a contact charging means using a charging roller as shown in FIGURE, the pre-exposure is not necessarily required.

In the present invention, the apparatus may be constituted of a combination of plural components joined into one unit as a process cartridge from among the constituents such as the above electrophotographic photosensitive member 1, primary charging means 3, developing means 5 and cleaning means 9 so that the process cartridge is detachable from the body of an electrophotographic apparatus such as a copying machine or a laser beam printer. For example, at least one of the primary charging means 3, the developing means 5 and the cleaning means 9 may be supported in a cartridge together with the photosensitive member 1 to form a process cartridge 11 that is detachable from the body of the apparatus through a guide means such as a rail 12 installed in the body of the apparatus.

When the electrophotographic apparatus is used as a copying machine or a printer, the image-like exposing light 4 is the light reflected from, or transmitted through, an original, or the light irradiated by the scanning of a laser beam, the driving of an LED array or the driving of a liquid crystal shutter array according to signals obtained by reading an original through a sensor and converting the information into signals.

The electrophotographic photosensitive member of the present invention may be not only used in electrophotographic copying machines, but also widely applied in the fields where electrophotography is applied, for example, laser beam printers, CRT printers, LED printers, liquid-crystal printers and laser beam engravers.

The present invention will be described below in greater detail by giving Examples. In the following Examples, "part(s)" refers to "part(s) by weight".

Example 1

200 parts of conductive titanium oxide coated with tin oxide containing 10% of antimony oxide, 250 parts of phenol resin, 200 parts of methyl cellosolve and 50 parts of methanol were dispersed for 2 hours by a sand mill that uses glass beads 1 mm in diameter, to prepare a conductive layer coating fluid. An aluminum cylinder was dip-coated with the coating fluid thus prepared, followed by drying at 150° C. for 25 minutes. The conductive layer thickness was 20 $\mu$m.

Next, 75 parts of N-methoxymethylated nylon 6 having been purified by re-precipitation and 25 parts of 6/12/66/610 copolymer nylon were dissolved in a mixed solvent of 500 parts of methanol and 500 parts of butanol to prepare an intermediate layer coating fluid. The above aluminum cylinder having been provided with the conductive layer was dip-coated with the above coating fluid, followed by drying at 95° C. for 7 minutes. The intermediate layer thickness was 0.50 $\mu$m.

Next, 40 parts of an azo pigment having the following structural formula:

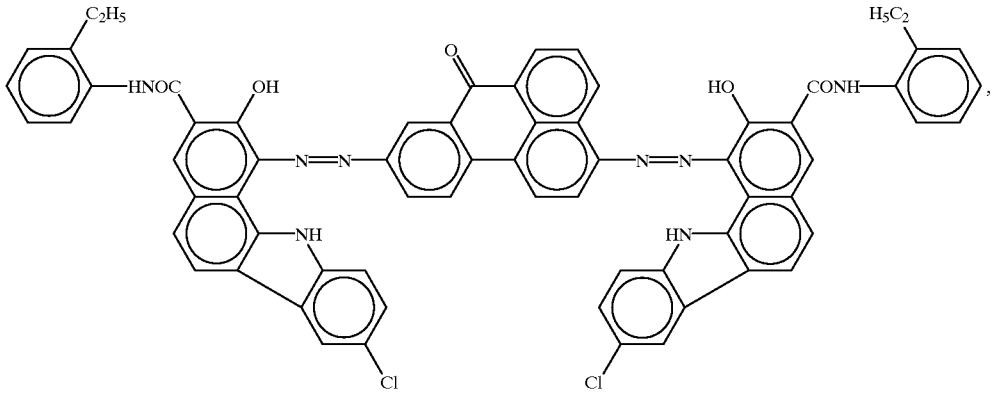

20 parts of polyvinyl butyral resin (BLS, available from Sekisui Chemical Co., Ltd.) and 500 parts of cyclohexanone were dispersed for 24 hours by a sand mill making use of glass beads 1 mm in diameter, and 500 parts of tetrahydrofuran was further added to prepare a charge generation layer coating fluid. The above cylinder having been provided with the intermediate layer was dip-coated with the charge generation layer coating fluid thus prepared, followed by drying at 85° C. for 7 minutes. The charge generation layer thickness was 0.15 $\mu$m.

Next, 20 parts of a styryl compound having the following structural formula:

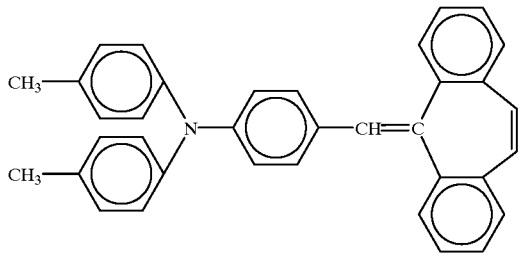

and 20 parts of a resin having the structural unit as shown in Table 1 were dissolved and in a mixed solvent 60 parts of monochlorobenzene and 30 parts dichloromethane to prepare a charge transport layer coating fluid. The above aluminum cylinder having been provided with the charge generation layer was dip-coated with the coating fluid, followed by drying at 130° C. for 50 minutes. The charge transport layer thus formed was 25 $\mu$m thick.

This resin was synthesized in the following way.

The inside of a 5-liter high-pressure autoclave with an electromagnetic induction stirrer, having been well dried, was displaced by dry nitrogen in a conventional way. 2,400 g of cyclohexane was introduced into the autoclave, which was then kept at room temperature in an environment of dry nitrogen. Subsequently, n-butyl lithium (n-BuLi) was added thereto with 10.0 mmol of lithium atoms and 5.0 mmol of tetramethylethylenediamine (TMEDA) was further added, followed by stirring at room temperature for 10 minutes.

The temperature of the autoclave was raised to 40° C. and thereafter 600 g of 1,3-cyclohexadiene (CHD) was introduced into the autoclave to carry out a polymerization reaction at 40° C. for 4 hours. After the polymerization reaction was completed, dehydrated n-heptanol was added in an amount equimolar to Li atoms to terminate the polymerization reaction. To the resultant polymer solution, IRGANOX B215 (0037HX), available from Ciba-Geigy, was added as a stabilizer, and desolvation was effected by a conventional method to obtain a CHD homopolymer. An addition reaction with chlorine was further carried out by a conventional method.

The resin thus obtained had a weight-average molecular weight of 40,000. The molecular weight was measured by GPC (gel permeation chromatography).

The electrophotographic photosensitive member produced in this way was set in a copying machine GP-55, manufactured by CANON INC., having a corona charging means as the primary charging means and whose cleaning blade was set at a higher linear pressure of 50 g/cm. A 5,000-sheet running test was conducted in an environment of normal temperature and normal humidity, and the scrape of the surface layer was measured with an eddy-current layer thickness measuring device (Permascope Type-E111, manufactured by Fischer Co.). The results are shown in Table 1.

Examples 2 to 7

Electrophotographic photosensitive members were produced in the same manner as in Example 1 except that the resin for the charge transport layer was replaced with those shown in Table 1. A similar evaluation was made similarly. The results are shown in Table 1.

TABLE 1

| | Structural unit of Formula (1) | | | Weight= average molecular | Scrape |
|---|---|---|---|---|---|
| | n | $R_1$ | $R_2$ | weight | ($\mu$m) |
| Example: | | | | | |
| 1 | 2 | Two: —Cl<br>The rest: H | All: H | 40,000 | 1.0 |
| 2 | 2 | One: —$CH_3$<br>The rest: H | All: H | 42,000 | 0.9 |
| 3 | 2 | One: 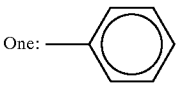 <br>The rest: H | All: H | 45,000 | 1.1 |
| 4 | 2 | One: —$OCH_3$<br>The rest: H | All: H | 42,000 | 1.3 |
| 5 | 3 | One: —$CH_3$<br>The rest: H | All: H | 45,000 | 1.2 |
| 6 | 1 | One: —$CH_3$<br>The rest: H | All: H | 43,000 | 0.9 |
| 7 | 4 | One: —$C_2H_5$<br>The rest: H | All: H | 48,000 | 1.0 |

Example 8

An electrophotographic photosensitive member was produced in the same manner as in Example 1 except that the resin for the charge transport layer was replaced with the one shown in Table 2 which was prepared in the manner described below. A similar evaluation was made similarly. The results are shown in Table 2.

The inside of a 5-liter high-pressure autoclave with an electromagnetic induction stirrer, having been well dried, was displaced by dry nitrogen in a conventional way. 2,133 g of cyclohexane was introduced into the autoclave, which was then kept at room temperature in an environment of dry nitrogen. Subsequently, n-BuLi was added thereto with 10.0 mmol of lithium atoms and 5.0 mmol of TMEDA was further added, followed by stirring at room temperature for 10 minutes.

The temperature of the autoclave was raised to 40° C. and thereafter 667 g of a cyclohexane solution of 30% by weight of butadiene (Bd) (Bd: 200 g) was introduced into the autoclave to carry out a polymerization reaction at 40° C. for 2 hours, obtaining a Bd homopolymer. Then, 200 g of 1,3-cyclohexadiene (CHD) was further introduced into the autoclave to carry out a polymerization reaction at 40° C. for 5 hours. After the polymerization reaction was completed, dehydrated n-heptanol was added in an amount equimolar to Li atoms to terminate the polymerization reaction. Desolvation was effected by a conventional method to obtain a Bd-CHD di-block copolymer.

Next, the inside of a 4-liter high-pressure autoclave with an electromagnetic induction stirrer, having been well dried, was displaced by dry nitrogen in a conventional way. 1,000 g of cyclohexane was introduced into the autoclave, which was then kept at 70° C. in an environment of dry nitrogen. Into this autoclave, 1,000 g of a cyclohexane solution of 10% by weight of the Bd-CHD di-block copolymer previously obtained was introduced, and 50 g of a solid catalyst comprising 5% by weight of palladium (Pd) supported on barium sulfate ($BaSO_4$) was added thereto.

The inside of the autoclave was displaced by hydrogen and its temperature was raised to 160° C. Then, hydrogenation reaction was carried out at a hydrogen pressure of 55 kg/cm$^2$G. After the hydrogenation reaction was completed, IRGANOX B215 (0037HX), available from Ciba-Geigy, was added as a stabilizer, and desolvation was effected by a conventional method.

The resin thus obtained had a weight-average molecular weight of 41,000.

The double bonds contained in the hydrogenated polymer had been hydrogenated by 100 molt at both of the CHD moiety and the Bd moiety as calculated by $^1$H-NMR measurement.

Examples 9 to 18

Electrophotographic photosensitive members were produced in the same manner as in Example 8 except that the resin for the charge transport layer was replaced with those shown in Table 2. A similar evaluation was made similarly. The results are shown in Table 2.

Example 19

An electrophotographic photosensitive member was produced in the same manner as in Example 17 except that the hydrogen pressure of the conditions for the hydrogenation of the resin was changed from 55 kg/cm$^2$G to 35 kg/cm$^2$G. The double bonds contained in the hydrogenated polymer had been hydrogenated by 58 mol % as calculated by $^1$H-NMR measurement of the resin obtained. The resin had a weight-average molecular weight of 40,000. Evaluation was also made in the same manner as in Example 17. The scrape after the running test was 0.8 $\mu$m.

Example 20

An electrophotographic photosensitive member was produced in the same manner as in Example 8 except that the resin for the charge transport layer was replaced with the one shown in Table 2 which was prepared in the manner described below. Evaluation was made similarly. The results are shown in Table 2.

The inside of a 5-liter high-pressure autoclave with an electromagnetic induction stirrer, having been well dried, was displaced by dry nitrogen in a conventional way. 1,533 g of cyclohexane was introduced into the autoclave, which was then kept at room temperature in an environment of dry nitrogen. Subsequently, n-BuLi was added thereto with 10.0 mmol of lithium atoms and 5.0 mmol of TMEDA was further added, followed by stirring at room temperature for 10 minutes.

The temperature of the autoclave was raised to 40° C. and thereafter 100 g of 1,3-CHD was introduced into the autoclave to carry out polymerization reaction at 40° C for 2 hours, obtaining a CHD homopolymer. Subsequently, 667 g of a cyclohexane solution of 30% by weight of butadiene (Bd) (Bd: 200 g) was introduced into the autoclave to carry out a polymerization reaction at 40° C. for 2 hours, obtaining a Bd-CHD di-block copolymer. Then, 100 g of 1,3-CHD was further introduced into the autoclave to carry out a polymerization reaction at 40° C. for 4 hours. Thus, a CHD-Bd-CHD tri-block copolymer was obtained. After the a polymerization reaction was completed, dehydrated n-heptanol was added in an amount equimolar to Li atoms to terminate the polymerization reaction.

Next, the inside of a 4-liter high-pressure autoclave with an electromagnetic induction stirrer, having been well dried, was displaced by dry nitrogen in a conventional way. 1,000 g of cyclohexane was introduced into the autoclave, which was then kept at 70° C. in an environment of dry nitrogen. 1,000 g of a cyclohexane solution of 10% by weight of the CHD-Bd-CHD tri-block copolymer previously obtained was introduced into the autoclave, and 50 g of a solid catalyst comprising 5% by weight of palladium (Pd) supported on barium sulfate ($BaSO_4$) was added thereto.

The inside of the autoclave was displaced by hydrogen and its temperature was raised to 160° C. Also, hydrogenation reaction was carried out at a hydrogeneration pressure of 55 kg/cm$^2$G. After the hydrogenation reaction was completed, IRGANOX B215 (0037HX), available from Ciba-Geigy, was added as a stabilizer, and desolvation was effected by a conventional method.

Examples 21 and 22

Electrophotographic photosensitive members were produced and evaluated in the same manner as in Example 20 except that the resin for the charge transport layer was replaced with those shown in Table 2. The results are shown in Table 2.

TABLE 2

| Structural unit of Formula (1) | | Other constituent | | | |
|---|---|---|---|---|---|
| | Molar fraction in polymer | Structural unit | Molar fraction in polymer | Weight= average molecular weight | Scrape (μm) |
| Example: | | | | | |
| 8 | 50% | —($CH_2$—CH=CH—$CH_2$)— | 50% | 41,000 | 1.1 |
| 9 | 50% | —($CH_2$—CH=CH—$CH_2$)— | 50% | 80,000 | 1.1 |
| 10 | 70% | —($CH_2$—CH=CH—$CH_2$)— | 30% | 43,000 | 1.0 |
| 11 | 70% | —($CH_2$—CH=CH—$CH_2$)— | 30% | 78,000 | 1.0 |
| 12 | 50% | —($CH_2$—CH)— 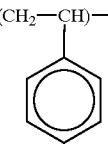 | 50% | 40,000 | 1.4 |
| 13 | 50% | —($CH_2$—CH)— 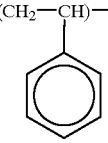 | 50% | 81,000 | 1.3 |
| 14 | 50% | —($CH_2$—C($CH_3$)($COOCH_3$))— | 50% | 40,000 | 1.3 |
| 15 | 70% | —($CH_2$—C($CH_3$)($COOCH_3$))— | 30% | 40,000 | 1.2 |
| 16 | 100% | — | | 10,000 | 1.2 |
| 17 | 100% | — | | 40,000 | 0.8 |
| 18 | 100% | — | | 80,000 | 0.8 |
| 19 | 100% | — | | 40,000 | 0.8 |

TABLE 2-continued

| | Structural unit of Formula (1) | Other constituent | | | |
|---|---|---|---|---|---|
| | Molar fraction in polymer | Structural unit | Molar fraction in polymer | Weight= average molecular weight | Scrape (μm) |
| 20 | 25%/25% | $-(CH_2-CH=CH-CH_2)-$ | 50% | 45,000 | 0.9 |
| 21 | 25%/25% | 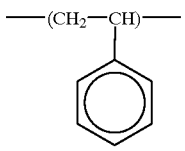 | 50% | 43,000 | 1.3 |
| 22 | 25%/25% | 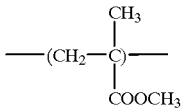 | 50% | 43,000 | 1.1 |

Example 23

An electrophotographic photosensitive member was produced in the same manner as in Example 8 except that the resin for the charge transport layer was replaced with 14 parts of a CHD copolymer prepared in the same manner as in Example 8 and 6 parts of a polymer having the structural unit shown below. A similar evaluation was made similarly. The results are shown in Table 3.

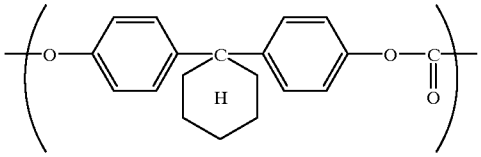

Example 24

An electrophotographic photosensitive member was produced in the same manner as in Example 23 except that the CHD copolymer as a resin for the charge transport layer was replaced with the CHD copolymer of Example 20. A similar evaluation was made similarly. The results are shown in Table 3.

Example 25

An electrophotographic photosensitive member was produced in the same manner as in Example 23 except that the CHD copolymer as one resin for the charge transport layer was replaced with the CHD copolymer of Example 22. A similar evaluation was made similarly. The results are shown in Table 3.

Example 26

An electrophotographic photosensitive member was produced in the same manner as in Example 23 except that the CHD copolymer as one resin for the charge transport layer was replaced with the CHD copolymer of Example 17. A similar evaluation was made similarly. The results are shown in Table 3.

Example 27

An electrophotographic photosensitive member was produced in the same manner as in Example 23 except that the resin for the charge transport layer was replaced with 10 parts of a CHD copolymer prepared in the same manner as in Example 17 and 10 parts of a polymer having the structural unit shown below. A similar evaluation was made similarly. The results are shown in Table 3.

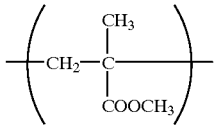

Example 28

An electrophotographic photosensitive member was produced in the same manner as in Example 23 except that the resin for the charge transport layer was replaced with 16 parts of a CHD copolymer prepared in the same manner as in Example 17 and 4 parts of a polymer having the structural unit shown below. A similar evaluation was made similarly. The results are shown in Table 3.

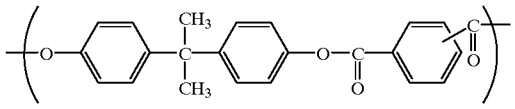

Example 29

An electrophotographic photosensitive member was produced in the same manner as in Example 8 except that the resin for the charge transport layer was replaced with 14 parts of a CHD copolymer prepared in the same manner as in Example 17 and 6 parts of a polymer having the structural unit shown below. A similar evaluation was made similarly. The results are shown in Table 3.

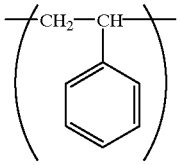

Comparative Example 1

An electrophotographic photosensitive member was produced in the same manner as in Example 1 except that the resin for the charge transport layer was replaced with a polymer having the structural unit shown below. A similar evaluation was made similarly. The results are shown in Table 4.

TABLE 3

| Polymers used | | | | | |
|---|---|---|---|---|---|
| | | Other polymer (B) | | | |
| | CHD= containing copolymer (A), same as | Structural unit | Weight= average molecular weight | Polymers (A)/(B) mixing ratio | Scrape (μm) |
| Example: | | | | | |
| 23 | 8* | 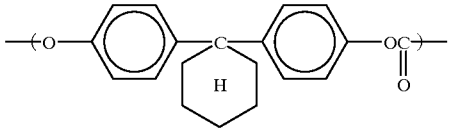 | 40,000 | 70/30 | 1.6 |
| 24 | 20* | 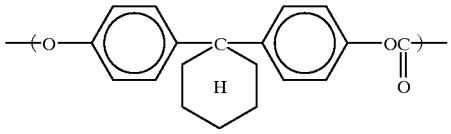 | 40,000 | 70/30 | 1.4 |
| 25 | 22* | 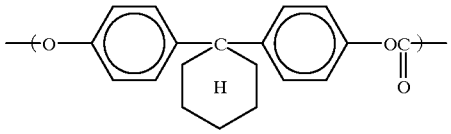 | 40,000 | 70/30 | 1.4 |
| 26 | 17* | 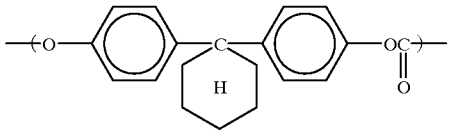 | 40,000 | 70/30 | 1.3 |
| 27 | 17* | 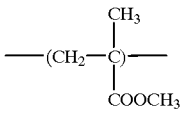 | 45,000 | 50/50 | 1.6 |
| 28 | 17* | 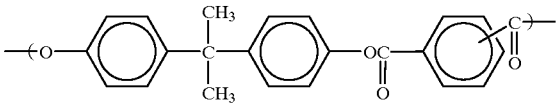 | 42,000 | 80/20 | 1.1 |
| 29 | 17* | 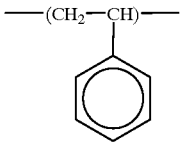 | 40,000 | 70/30 | 1.3 |

*Example No.

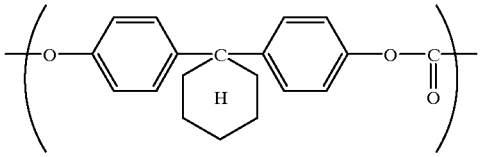

Comparative Example 2

An electrophotographic photosensitive member was produced in the same manner as in Example 1 except that the resin for the charge transport layer was replaced with a polymer having the structural unit shown below. A similar evaluation was made similarly. The results are shown in Table 4.

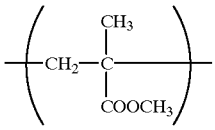

Comparative Example 3

An electrophotographic photosensitive member was produced in the same manner as in Example 1 except that the resin for the charge transport layer was replaced with a polymer having the structural unit shown below. A similar evaluation was made similarly. The results are shown in Table 4.

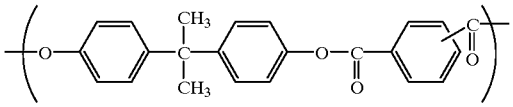

Example 30

A solution prepared by mixing 40 parts of oxytitanium phthalocyanine having strong peaks at Bragg's angles 2θ±0.2° of 9.0°, 14.2°, 23.9° and 27.1° as measured by CuKα characteristic X-ray diffraction, 2 parts of polyvinyl butyral (BLS, available from Sekisui Chemical Co., Ltd.) and 600 parts of cyclohexanone was dispersed for 4 hours by a sand mill that uses glass beads 1 mm in diameter, followed by addition of 1,000 parts of ethyl acetate to obtain a coating fluid. An electrophotographic photosensitive member was produced in the same manner as in Example 1 except that this fluid was used as the charge generation layer coating fluid.

The electrophotographic photosensitive member thus produced was set in a laser beam printer LASER WRITER 16/600PS, manufactured by Apple, having a contact charging means as the primary charging means and whose primary charging control system was modified into a constant-voltage control system. Using this printer, a 5,000-sheet running test was conducted in an environment was normal temperature and normal humidity, and the scrape of the surface layer was measured. The results are shown in Table 5.

Examples 31 to 36

Electrophotographic photosensitive members were produced in the same manner as in Examples 2 to 7, respectively, except that the coating fluid of Example 30 was used as the charge generation layer coating fluid. Evaluation was made in the same manner as in Example 30. The results are shown in Table 5.

TABLE 4

| | Polymer used | | |
|---|---|---|---|
| | Structural unit | Weight-average molecular weight | Scrape (μm) |
| Comparative Example: | | | |
| 1 | 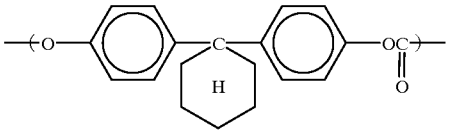 | 40,000 | 2.2 |
| 2 | 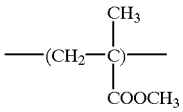 | 45,000 | 4.0 |
| 3 | 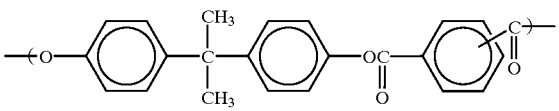 | 42,000 | 1.8 |

TABLE 5

| | Structural unit of Formula (1) | | | Weight= average molecular | Scrape |
|---|---|---|---|---|---|
| | n | $R_1$ | $R_2$ | weight | (μm) |
| Example: | | | | | |
| 30 | 2 | Two: —Cl<br>The rest: H | All: H | 40,000 | 3.5 |
| 31 | 2 | One: —$CH_3$<br>The rest: H | All: H | 42,000 | 3.3 |
| 32 | 2 | One: 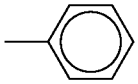 <br>The rest: H | All: H | 45,000 | 3.2 |
| 33 | 2 | One: —$OCH_3$<br>The rest: H | All: H | 42,000 | 3.1 |
| 34 | 3 | One: —$CH_3$<br>The rest: H | All: H | 45,000 | 3.3 |
| 35 | 1 | One: —$CH_3$<br>The rest: H | All: H | 43,000 | 3.2 |

TABLE 5-continued

| | Structural unit of Formula (1) | | | Weight= average molecular | Scrape |
|---|---|---|---|---|---|
| | n | $R_1$ | $R_2$ | weight | (μm) |
| 36 | 4 | One: —$C_2H_5$<br>The rest: H | All: H | 48,000 | 3.3 |

Examples 37 to 51

Electrophotographic photosensitive members were produced in the same manner as in Examples 8 to 22, respectively, except that the coating fluid of Example 30 was used as the charge generation layer coating fluid. Evaluation was made in the same manner as in Example 30. The results are shown in Table 6.

TABLE 6

| | Structural unit of Formula (1) | Other constituent | | | |
|---|---|---|---|---|---|
| | Molar fraction in polymer | Structural unit | Molar fraction in polymer | Weight= average molecular weight | Scrape (μm) |
| Example: | | | | | |
| 37 | 50% | —($CH_2$—CH=CH—$CH_2$)— | 50% | 41,000 | 3.5 |
| 38 | 50% | —($CH_2$—CH=CH—$CH_2$)— | 50% | 80,000 | 3.4 |
| 39 | 70% | —($CH_2$—CH=CH—$CH_2$)— | 30% | 43,000 | 3.4 |
| 40 | 70% | —($CH_2$—CH=CH—$CH_2$)— | 30% | 78,000 | 3.4 |
| 41 | 50% | —($CH_2$—CH)— 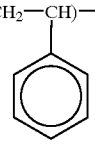 | 50% | 40,000 | 4.0 |
| 42 | 50% | —($CH_2$—CH)— 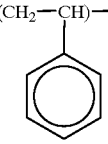 | 50% | 81,000 | 3.8 |
| 43 | 50% | —($CH_2$—C($CH_3$)($COOCH_3$))— | 50% | 40,000 | 3.7 |
| 44 | 70% | —($CH_2$—C($CH_3$)($COOCH_3$))— | 30% | 40,000 | 3.6 |
| 45 | 100% | — | | 10,000 | 3.2 |
| 46 | 100% | — | | 40,000 | 3.0 |
| 47 | 100% | — | | 80,000 | 2.9 |
| 48 | 100% | — | | 40,000 | 3.1 |
| 49 | 25%/25% | —($CH_2$—CH=CH—$CH_2$)— | 50% | 45,000 | 3.3 |

TABLE 6-continued

| Structural unit of Formula (1) | | Other constituent | | | |
|---|---|---|---|---|---|
| | Molar fraction in polymer | Structural unit | Molar fraction in polymer | Weight= average molecular weight | Scrape (μm) |
| 50 | 25%/25% | —(CH$_2$—CH)— 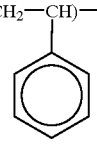 | 50% | 43,000 | 3.8 |
| 51 | 25%/25% | —(CH$_2$—C(CH$_3$)(COOCH$_3$))— | 50% | 43,000 | 3.8 |

Examples 52 to 58

Electrophotographic photosensitive members were produced in the same manner as in Examples 23 to 29, respectively, except that the coating fluid of Example 30 was used as the charge generation layer coating fluid. Evaluation was made in the same manner as in Example 30. The results are shown in Table 7.

TABLE 7

| Polymers used | | | | | |
|---|---|---|---|---|---|
| | | Other polymer (B) | | | |
| | CHD= containing copolymer (A), same as | Structural unit | Weight= average molecular weight | Polymers (A)/(B) mixing ratio | Scrape (μm) |
| Example: | | | | | |
| 52 | 8* | 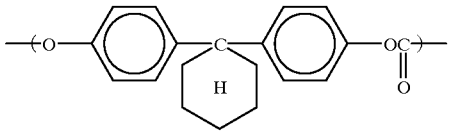 | 40,000 | 70/30 | 4.2 |
| 53 | 20* | 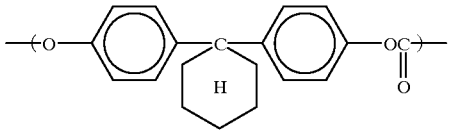 | 40,000 | 70/30 | 4.1 |
| 54 | 22* | 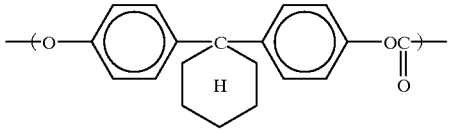 | 40,000 | 70/30 | 4.3 |

TABLE 7-continued

| Polymers used | | | | | |
|---|---|---|---|---|---|
| | | Other polymer (B) | | | |
| | CHD= containing copolymer (A), same as | Structural unit | Weight= average molecular weight | Polymers (A)/(B) mixing ratio | Scrape (μm) |
| 55 | 17* | 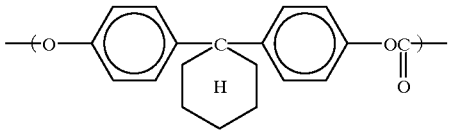 | 40,000 | 70/30 | 4.0 |
| 56 | 17* | 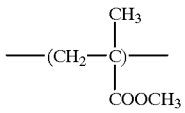 | 45,000 | 50/50 | 4.3 |
| 57 | 17* | 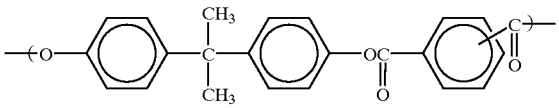 | 40,000 | 80/20 | 3.5 |
| 58 | 17* | 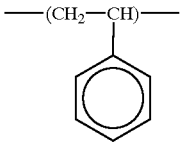 | 40,000 | 70/30 | 4.0 |

*Example No.

Comparative Examples 4 to 6

Electrophotographic photosensitive members were produced in the same manner as in Comparative Examples 1 to 3, respectively, except that the coating fluid of Example 30 was used as the charge generation layer coating fluid. Evaluation was made in the same manner as in Example 30. The results are shown in Table 8.

TABLE 8

| Polymer used | | | |
|---|---|---|---|
| | Structural unit | Weight-average molecular weight | Scrape (μm) |
| Comparative Example: | | | |
| 4 | 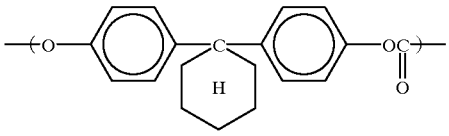 | 40,000 | 10.3 |
| 5 | 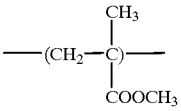 | 45,000 | 15.7 |
| 6 | 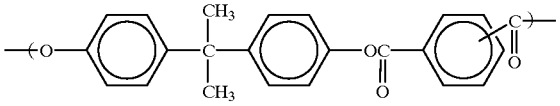 | 42,000 | 6.6 |

Example 59

An electrophotographic photosensitive member was produced in the same manner as in Example 1 except that the resin for the charge transport layer was replaced with the one prepared in the manner described below. A similar evaluation was made similarly. The results are shown in Table 9.

The inside of a 5-liter high-pressure autoclave with an electromagnetic induction stirrer, having been well dried, was displaced by dry nitrogen in a conventional way. 2,400 g of cyclohexane was introduced into the autoclave, which was then kept at room temperature in an environment of dry nitrogen. Subsequently, n-butyl lithium (n-BuLi) was added thereto with 10.0 mmol of lithium atoms and 5.0 mmol of TMEDA was further added, followed by stirring at room temperature for 10 minutes.

The temperature of the autoclave was raised to 40° C. and thereafter 720 g of 5-methyl-1,3-cyclohexadiene was introduced into the autoclave to carry out a polymerization reaction at 40° C. for 5 hours. After the polymerization reaction was completed, dehydrated n-heptanol was added in an amount equimolar to Li atoms to terminate the polymerization reaction. To the resultant polymer solution, IRGANOX B215 (0037HX), available from Ciba-Geigy, was added as a stabilizer, and desolvation was effected by a conventional method. The resin thus obtained had a weight-average molecular weight of 43,000.

Examples 60 and 63

Electrophotographic photosensitive members were produced in the same manner as in Example 59 except that the resin for the charge transport layer was replaced with those shown in Table 9. A similar evaluation was made similarly. The results are shown in Table 9.

TABLE 9

| | Structural unit of Formula (2) | | | Weight = average molecular | Scrape |
|---|---|---|---|---|---|
| | m | $R_3$ | $R_4$ | weight | ($\mu$m) |
| Example: | | | | | |
| 59 | 2 | One: —$CH_3$ The rest: H | All: H | 43,000 | 1.2 |
| 60 | 2 | Two: —Cl The rest: H | All: H | 42,000 | 1.4 |
| 61 | 3 | One: —$CH_3$ The rest: H | All: H | 44,000 | 1.4 |
| 62 | 1 | One: —$CH_3$ The rest: H | All: H | 43,000 | 1.5 |
| 63 | 4 | One: —$C_2H_5$ The rest: H | All: H | 48,000 | 1.5 |

Example 64

An electrophotographic photosensitive member was produced in the same manner as in Example 59 except that the resin for the charge transport layer was replaced with the one shown in Table 10 which was prepared in the manner described below. A similar evaluation was made similarly. The results are shown in Table 10.

The inside of a 5-liter high-pressure autoclave with an electromagnetic induction stirrer, having been well dried, was displaced by dry nitrogen in a conventional way. 2,133 g of cyclohexane was introduced into the autoclave, which was then kept at room temperature in an environment of dry nitrogen. Subsequently, n-BuLi was added thereto in an amount of 10.0 mmol of lithium atoms and 5.0 mmol of TMEDA was further added, followed by stirring at room temperature for 10 minutes.

The temperature of the autoclave was raised to 40° C. and thereafter 667 g of a cyclohexane solution of 30% by weight of butadiene (Bd) (Bd: 200 g) was introduced into the autoclave to carry out a polymerization reaction at 40° C. for 2 hours, obtaining a Bd homopolymer. Then, 200 g of 1,3-cyclohexadiene (CHD) was further introduced into the autoclave to carry out a polymerization reaction at 40° C. for 5 hours. After the polymerization reaction was completed, dehydrated n-heptanol was added in an amount equimolar to Li atoms to terminate the polymerization reaction. To the resultant polymer solution, IRGANOX B215 (0037HX), available from Ciba-Geigy, was added as a stabilizer, and desolvation was effected by a conventional method. Thus, a Bd-CHD di-block copolymer was obtained.

Examples 65 to 74

Electrophotographic photosensitive members were produced in the same manner as in Example 64 except that the resin for the charge transport layer was replaced with those shown in Table 10. A similar evaluation was made similarly. The results are shown in Table 10.

Example 75

An electrophotographic photosensitive member was produced in the same manner as in Example 64 except that the resin for the charge transport layer was replaced with the one shown in Table 10 which was prepared in the manner described below. A similar evaluation was made similarly. The results are shown in Table 10.

The inside of a 5-liter high-pressure autoclave with an electromagnetic induction stirrer, having been well dried, was displaced by dry nitrogen in a conventional way. 1,533 g of cyclohexane was introduced into the autoclave, which was then kept at room temperature in an environment of dry nitrogen. Subsequently, n-BuLi was added thereto with 10.0 mmol in terms of lithium atoms and 5.0 mmol of TMEDA was further added, followed by stirring at room temperature for 10 minutes.

The temperature of the autoclave was raised to 40° C. and thereafter 100 g of 1,3-CHD was introduced into the autoclave to carry out a polymerization reaction at 40° C for 2 hours, obtaining a CHD homopolymer. Subsequently, 667 g of a cyclohexane solution of 30% by weight of butadiene (Bd) (Bd: 200 g) was introduced into the autoclave to carry out a polymerization reaction at 40° C. for 2 hours, obtaining a Bd-CHD di-block copolymer. Then, 100 g of 1,3-CHD was further introduced into the autoclave to carry out a polymerization reaction at 40° C. for 4 hours. Thus, a CHD-Bd-CHD tri-block copolymer was obtained. After the polymerization reaction was completed, dehydrated n-heptanol was added in an amount equimolar to Li atoms to terminate the polymerization reaction. To the resultant polymer solution, IRGANOX B215 (0037HX), available from Ciba-Geigy, was added as a stabilizer, and desolvation was effected by a conventional method.

Examples 76 and 77

Electrophotographic photosensitive members were produced in the same manner as in Example 75 except that the resin for the charge transport layer was replaced with those shown in Table 10. A similar evaluation was made similarly. The results are shown in Table 10.

TABLE 10

| Structural unit of Formula (1) | | Other constituent | | | |
|---|---|---|---|---|---|
| | Molar fraction in polymer | Structural unit | Molar fraction in polymer | Weight= average molecular weight | Scrape (μm) |
| Example: | | | | | |
| 64 | 50% | —(CH$_2$—CH=CH—CH$_2$)— | 50% | 41,000 | 1.3 |
| 65 | 50% | —(CH$_2$—CH=CH—CH$_2$)— | 50% | 80,000 | 1.2 |
| 66 | 70% | —(CH$_2$—CH=CH—CH$_2$)— | 30% | 43,000 | 1.1 |
| 67 | 70% | —(CH$_2$—CH=CH—CH$_2$)— | 30% | 78,000 | 1.0 |
| 68 | 50% | 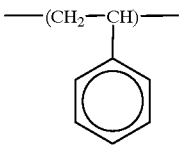 | 50% | 40,000 | 1.5 |
| 69 | 50% | 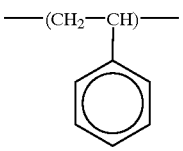 | 50% | 81,000 | 1.3 |
| 70 | 50% | 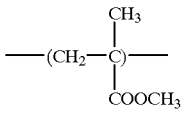 | 50% | 40,000 | 1.5 |
| 71 | 70% | 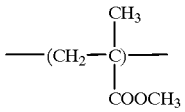 | 30% | 40,000 | 1.3 |
| 72 | 100% | — | | 10,000 | 1.1 |
| 73 | 100% | — | | 40,000 | 0.9 |
| 74 | 100% | — | | 80,000 | 0.9 |
| 75 | 25%/25% | —(CH$_2$—CH=CH—CH$_2$)— | 50% | 45,000 | 1.1 |
| 76 | 25%/25% | 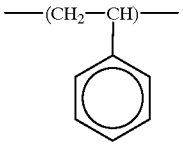 | 50% | 43,000 | 1.3 |
| 77 | 25%/25% | 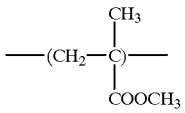 | 50% | 43,000 | 1.2 |

Example 78

An electrophotographic photosensitive member was produced in the same manner as in Example 64 except that the resin for the charge transport layer was replaced with 14 parts of a CHD copolymer prepared in the same manner as in Example 64 and 6 parts of a polymer having the structural unit shown below. A similar evaluation was made similarly. The results are shown in Table 11.

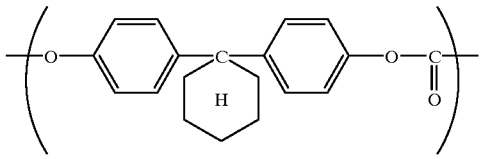

Example 79

An electrophotographic photosensitive member was produced in the same manner as in Example 78 except that the CHD copolymer as a resin for the charge transport layer was replaced with the CHD copolymer of Example 75. A similar evaluation was made similarly. The results are shown in Table 11.

Example 80

An electrophotographic photosensitive member was produced in the same manner as in Example 78 except that the CHD copolymer as a resin for the charge transport layer was replaced with the CHD copolymer of Example 77. A similar evaluation was made similarly. The results are shown in Table 11.

Example 81

An electrophotographic photosensitive member was produced in the same manner as in Example 78 except that the CHD copolymer as a resin for the charge transport layer was replaced with the CHD copolymer of Example 73. A similar evaluation was made similarly. The results are shown in Table 11.

Example 82

An electrophotographic photosensitive member was produced in the same manner as in Example 64 except that the resin for the charge transport layer was replaced with 10 parts of a CHD copolymer prepared in the same manner as in Example 73 and 10 parts of a polymer having the structural unit shown below. A similar evaluation was made similarly. The results are shown in Table 11.

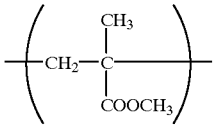

Example 83

An electrophotographic photosensitive member was produced in the same manner as in Example 64 except that the resin for the charge transport layer was replaced with 16 parts of a CHD copolymer prepared in the same manner as in Example 73 and 4 parts of a polymer having the structural unit shown below. A similar evaluation was made similarly. The results are shown in Table 11.

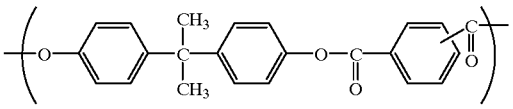

Example 84

An electrophotographic photosensitive member was produced in the same manner as in Example 64 except that the resin for the charge transport layer was replaced with 14 parts of a CHD copolymer prepared in the same manner as in Example 73 and 6 parts of a polymer having the structural unit shown below. A similar evaluation was made similarly. The results are shown in Table 11.

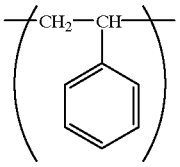

TABLE 11

| Polymers used | | | | |
|---|---|---|---|---|
| | Other polymer (B) | | | |
| CHD= containing copolymer (A), same as | Structural unit | Weight= average molecular weight | Polymers (A)/(B) mixing ratio | Scrape (μm) |
| Example: | | | | |
| 78 | 64* 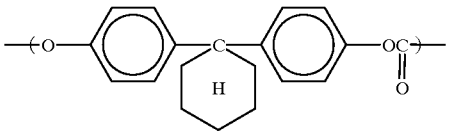 | 40,000 | 70/30 | 1.7 |
| 79 | 75* 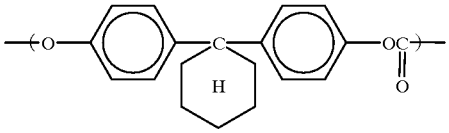 | 40,000 | 70/30 | 1.5 |

TABLE 11-continued

| | Polymers used | | | | |
|---|---|---|---|---|---|
| | | Other polymer (B) | | | |
| | CHD= containing copolymer (A), same as | Structural unit | Weight= average molecular weight | Polymers (A)/(B) mixing ratio | Scrape (μm) |
| 80 | 77* | 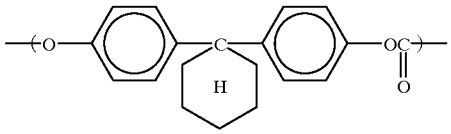 | 40,000 | 70/30 | 1.7 |
| 81 | 73* | 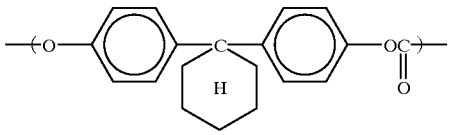 | 40,000 | 70/30 | 1.4 |
| 82 | 73* | 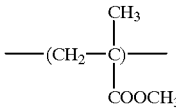 | 45,000 | 50/50 | 1.8 |
| 83 | 73* | 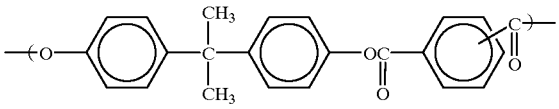 | 42,000 | 80/20 | 1.3 |
| 84 | 73* | 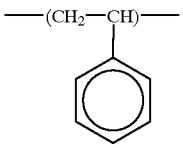 | 40,000 | 70/30 | 1.5 |

*Example No.

Examples 85 to 89

Electrophotographic photosensitive members were produced in the same manner as in Examples 59 to 63, respectively, except that the coating fluid of Example 30 was used as the charge generation layer coating fluid. Evaluation was made in the same manner as in Example 30. The results are shown in Table 12.

TABLE 12

| | Structural unit of Formula (2) | | | Weight = average molecular weight | Scrape (μm) |
|---|---|---|---|---|---|
| | m | $R_3$ | $R_4$ | | |
| Example: | | | | | |
| 85 | 2 | One: —$CH_3$ The rest: H | All: H | 43,000 | 3.5 |
| 86 | 2 | One: —Cl The rest: H | All: H | 42,000 | 4.0 |
| 87 | 3 | One: —$CH_3$ The rest: H | All: H | 44,000 | 4.2 |

TABLE 12-continued

| | Structural unit of Formula (2) | | | Weight = average molecular weight | Scrape (μm) |
|---|---|---|---|---|---|
| | m | $R_3$ | $R_4$ | | |
| 88 | 1 | One: —$CH_3$ The rest: H | All: H | 43,000 | 3.8 |
| 89 | 4 | One: —$C_2H_5$ The rest: H | All: H | 48,000 | 3.9 |

Examples 90 to 103

Electrophotographic photosensitive members were produced in the same manner as in Examples 64 to 77, respectively, except that the coating fluid of Example 30 was used as the charge generation layer coating fluid. Evaluation was made in the same manner as in Example 85. The results are shown in Table 13.

TABLE 13

| Structural unit of Formula (2) | | Other constituent | | | |
|---|---|---|---|---|---|
| | Molar fraction in polymer | Structural unit | Molar fraction in polymer | Weight= average molecular weight | Scrape ($\mu$m) |
| Example: | | | | | |
| 90 | 50% | —($CH_2$—CH=CH—$CH_2$)— | 50% | 41,000 | 3.8 |
| 91 | 50% | —($CH_2$—CH=CH—$CH_2$)— | 50% | 80,000 | 3.8 |
| 92 | 70% | —($CH_2$—CH=CH—$CH_2$)— | 30% | 43,000 | 3.7 |
| 93 | 70% | —($CH_2$—CH=CH—$CH_2$)— | 30% | 78,000 | 3.7 |
| 94 | 50% | —($CH_2$—CH)— 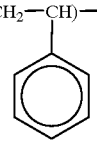 | 50% | 40,000 | 4.2 |
| 95 | 50% | —($CH_2$—CH)— 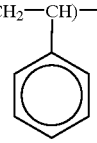 | 50% | 81,000 | 4.0 |
| 96 | 50% | —($CH_2$—C($CH_3$)($COOCH_3$))— | 50% | 40,000 | 4.0 |
| 97 | 70% | —($CH_2$—C($CH_3$)($COOCH_3$))— | 30% | 40,000 | 4.0 |
| 98 | 100% | — | | 10,000 | 3.5 |
| 99 | 100% | — | | 40,000 | 3.2 |
| 100 | 100% | — | | 80,000 | 3.1 |
| 101 | 25%/25% | —($CH_2$—CH=CH—$CH_2$)— | 50% | 45,000 | 3.5 |
| 102 | 25%/25% | —($CH_2$—CH)— 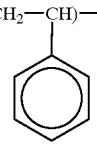 | 50% | 43,000 | 3.9 |
| 103 | 25%/25% | —($CH_2$—C($CH_3$)($COOCH_3$))— | 50% | 43,000 | 3.8 |

Examples 104 to 110

Electrophotographic photosensitive members were produced in the same manner as in Examples 78 to 84, respectively, except that the coating fluid of Example 30 was used as the charge generation layer coating fluid. Evaluation was made in the same manner as in Example 85. The results are shown in Table 14.

TABLE 14

| | Polymers used | | | | |
|---|---|---|---|---|---|
| | | Other polymer (B) | | | |
| | CHD= containing copolymer (A), same as | Structural unit | Weight= average molecular weight | Polymers (A)/(B) mixing ratio | Scrape ($\mu$m) |
| Example: | | | | | |
| 104 | 64* | 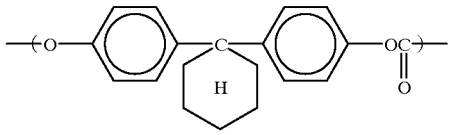 | 40,000 | 70/30 | 4.3 |
| 105 | 75* | 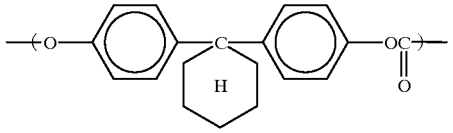 | 40,000 | 70/30 | 4.2 |
| 106 | 77* | 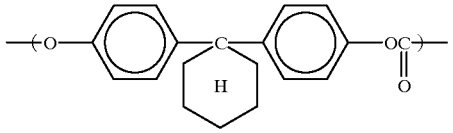 | 40,000 | 70/30 | 4.4 |
| 107 | 73* | 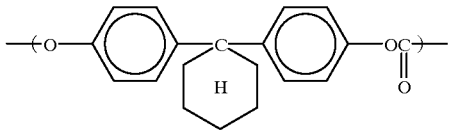 | 40,000 | 70/30 | 3.9 |
| 108 | 73* | 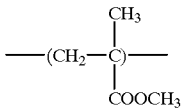 | 45,000 | 50/50 | 4.5 |
| 109 | 73* | 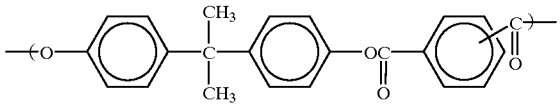 | 42,000 | 80/20 | 3.7 |
| 110 | 73* | 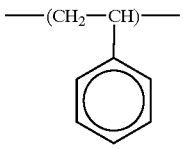 | 40,000 | 70/30 | 4.2 |

*Example No.

Example 111

An electrophotographic photosensitive member was produced in the same manner as in Example 1 except that the resin for the charge transport layer was replaced with the one prepared in the manner described below. A similar evaluation was made similarly, provided that the paper-feed running test was conducted on 2,000 sheets. The results are shown in Table 15.

100 ml of a cyclohexadiene monomer, 40 ml of a methyl methacrylate monomer, 300 ml of benzene and 50 ml of azobisisobutyronitrile (AIBN) were mixed, and then heated to 100° C. with stirring. Two hours after, the mixture was by drops added to methanol to precipitate a polymer. Precipitation was repeated to purify the polymer, followed by vacuum drying. The resultant polymer was dissolved in 1,000 ml of cyclohexane, which was then put into a high-pressure autoclave the inside of which had been displaced by hydrogen, and the temperature was raised to 160° C. Then, hydrogeneration reaction was carried out at a hydrogen pressure of 55 kg/cm$^2$G for 6 hours. After the hydrogenation reaction was completed, IRGANOX B215 (0037HX), available from Ciba-Geigy, was added, and desolvation was effected. The double bonds held in the hydrogenated polymer had been hydrogenated by 99 mol % as calculated by $^1$H-NMR measurement. The final yield was 50%. The resin thus obtained had a weight-average molecular weight of 25,000.

Examples 112 to 120

Electrophotographic photosensitive members were produced in the same manner as in Example 111 except that the resin for the charge transport layer was replaced with those shown in Tables 15 and 16. A similar evaluation was made similarly. The results are shown in Tables 15 and 16.

Comparative Example 7

An electrophotographic photosensitive member was produced in the same manner as in Example 111 except that the resin for the charge transport layer was replaced with a resin having the structural unit shown below. A similar evaluation was made similarly. The results are shown in Table 16.

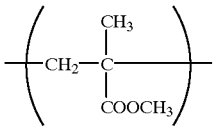

Comparative Example 8

An electrophotographic photosensitive member was produced in the same manner as in Example 111 except that the resin for the charge transport layer was replaced with a resin having the structural unit shown below. A similar evaluation was made similarly. The results are shown in Table 16.

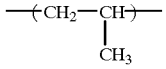

Examples 121 to 130

Electrophotographic photosensitive members were produced in the same manner as in Examples 111 to 120, respectively, except that the coating fluid of Example 30 was used as the charge generation layer coating fluid. Evaluation was made in the same manner as in Example 30, except that the paper-feed running test was made on 2,000 sheets. The results are shown in Tables 17 and 18.

Comparative Examples 9 and 10

Electrophotographic photosensitive members were produced in the same manner as in Comparative Examples 7 and 8, respectively, except that the coating fluid of Example 30 was used as the charge generation layer coating fluid. Evaluation was made in the same manner as in Example 121. The results are shown in Table 18.

TABLE 15

| | Constitution of polymer used | | | | | | | | | Weight= | |
|---|---|---|---|---|---|---|---|---|---|---|---|
| | Structural unit of Formula (1) | | | | 1 | | 2 | | | average | |
| Example: | n | $R_1$ | $R_2$ | Molar fraction* | Structural unit | Molar fraction* | Structural unit | Molar fraction* | | molecular weight | Scrape (μm) |
| 111 | 2 | All: H | All: H | 50% | 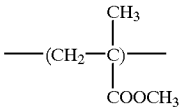 | 50% | — | — | | 25,000 | 0.8 |
| 112 | 2 | All: H | All: H | 50% | $-(CH_2-CH_2)-$ | 50% | — | — | | 20,000 | 0.6 |
| 113 | 2 | All: H | All: H | 50% | 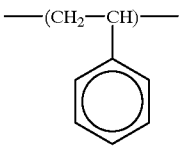 | 50% | — | — | | 22,000 | 0.7 |
| 114 | 2 | All: H | All: H | 70% | 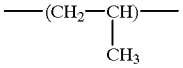 | 30% | — | — | | 25,000 | 1.0 |
| 115 | 2 | All: H | One: $CH_3$ The rest: H | 60% | 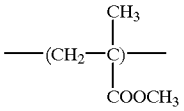 | 40% | — | — | | 20,000 | 0.8 |

TABLE 15-continued

| | Constitution of polymer used | | | | | | | | | Weight= | |
|---|---|---|---|---|---|---|---|---|---|---|---|
| | Structural unit of Formula (1) | | | | 1 | | 2 | | | average | |
| Example: | n | $R_1$ | $R_2$ | Molar fraction* | Structural unit | Molar fraction* | Structural unit | Molar fraction* | | molecular weight | Scrape (μm) |
| 116 | 2 | All: H | Two: Cl<br>The rest: H | 60% | $-(CH_2-C(CH_3)(COOCH_3))-$ | 40% | — | — | | 21,000 | 0.9 |
| 117 | 2 | All: H | All: H | 40% | $-(CH_2-CH(C_6H_5))-$ | 30% | $-(CH_2-C(CH_3)(COOCH_3))-$ | 30% | | 30,000 | 0.9 |

*in polymer

TABLE 16

| | Constitution of polymer used | | | | | | | | | Weight= | |
|---|---|---|---|---|---|---|---|---|---|---|---|
| | Structural unit of Formula (1) | | | | 1 | | 2 | | | average | |
| | n | $R_1$ | $R_2$ | Molar fraction* | Structural unit | Molar fraction* | Structural unit | Molar fraction* | | molecular weight | Scrape (μm) |
| Example: | | | | | | | | | | | |
| 118 | 1 | All: H | All: H | 50% | $-(CH_2-CH_2)-$ | 50% | — | — | | 24,000 | 0.7 |
| 119 | 3 | All: H | All: H | 40% | $-(CH_2-C(CH_3)(COOCH_3))-$ | 60% | — | — | | 28,000 | 0.7 |
| 120 | 4 | All: H | All: H | 40% | $-(CH_2-C(CH_3)(COOCH_3))-$ | 60% | — | — | | 25,000 | 0.7 |
| Comparative Example: | | | | | | | | | | | |
| 7 | — | — | — | — | $-(CH_2-C(CH_3)(COOCH_3))-$ | 100% | — | — | | 26,000 | 1.6 |
| 8 | — | — | — | — | $-(CH_2-CH(CH_3))-$ | 100% | — | — | | 20,000 | 2.0 |

*in polymer

TABLE 17

| | Constitution of polymer used | | | | | | | | Weight= | |
|---|---|---|---|---|---|---|---|---|---|---|
| | Structural unit of Formula (1) | | | | 1 | | 2 | | average | |
| Example: | $R_1$ | $R_2$ | fraction* | Molar unit | Structural fraction* | Molar unit | Structural fraction* | Molar weight | molecular (μm) | Scrape |
| 121 | 2 | All: H | All: H | 50% | $-(CH_2-C(CH_3)(COOCH_3))-$ | 50% | — | — | 25,000 | 2.0 |
| 122 | 2 | All: H | All: H | 50% | $-(CH_2-CH_2)-$ | 50% | — | — | 20,000 | 1.6 |
| 123 | 2 | All: H | All: H | 50% | $-(CH_2-CH(C_6H_5))-$ | 50% | — | — | 22,000 | 2.2 |
| 124 | 2 | All: H | All: H | 70% | $-(CH_2-CH(CH_3))-$ | 30% | — | — | 25,000 | 2.3 |
| 125 | 2 | All: H | One: $CH_3$ The rest: H | 60% | $-(CH_2-C(CH_3)(COOCH_3))-$ | 40% | — | — | 20,000 | 2.0 |
| 126 | 2 | All: H | Two: CL The rest: H | 60% | $-(CH_2-C(CH_3)(COOCH_3))-$ | 40% | — | — | 21,000 | 2.1 |
| 127 | 2 | All: H | All: H | 40% | $-(CH_2-CH(C_6H_5))-$ | 30% | $-(CH_2-C(CH_3)(COOCH_3))-$ | 30% | 30,000 | 2.3 |

*in polymer

TABLE 18

| | Constitution of polymer used | | | | | | | | Weight= | |
|---|---|---|---|---|---|---|---|---|---|---|
| | Structural unit of Formula (1) | | | | 1 | | 2 | | average | |
| | n | $R_1$ | $R_2$ | Molar fraction* | Structural unit | Molar fraction* | Structural unit | Molar fraction* | molecular weight | Scrape (μm) |
| Example: | | | | | | | | | | |
| 128 | 1 | All: H | All: H | 50% | $-(CH_2-CH_2)-$ | 50% | — | — | 24,000 | 1.8 |
| 129 | 3 | All: H | All: H | 40% | $-(CH_2-C(CH_3)(COOCH_3))-$ | 60% | — | — | 28,000 | 1.7 |

TABLE 18-continued

| | Constitution of polymer used | | | | | | | | Weight= | |
|---|---|---|---|---|---|---|---|---|---|---|
| | Structural unit of Formula (1) | | | | 1 | | 2 | | average | |
| | n | $R_1$ | $R_2$ | Molar fraction* | Structural unit | Molar fraction* | Structural unit | Molar fraction* | molecular weight | Scrape (μm) |
| 130 | 4 | All: H | All: H | 40% | $-(CH_2-C(CH_3)(COOCH_3))-$ | 60% | — | — | 25,000 | 1.8 |
| Comparative Example: | | | | | | | | | | |
| 9 | — | — | — | — | $-(CH_2-C(CH_3)(COOCH_3))-$ | 100% | — | — | 26,000 | 6.5 |
| 10 | — | — | — | — | $-(CH_2-CH(CH_3))-$ | 100% | — | — | 23,000 | 10.0 |

*in polymer

What is claimed is:

1. An electrophotographic photosensitive member comprising a support and a photosensitive layer provided on the support, wherein said electrophotographic photosensitive member has a surface layer containing a resin having at least one of repeating units represented by the following Formulas (1) and (2):

(1)

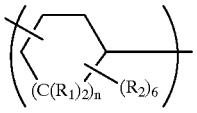

wherein n represents an integer of 0 or more; $R_1$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group; and $R_2$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group;

(2)

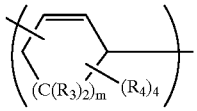

wherein m represents an integer of 0 or more; $R_3$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group; and $R_4$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group.

2. An electrophotographic photosensitive member according to claim 1, wherein the repeating unit is the one represented by Formula (1).

3. An electrophotographic photosensitive member according to claim 1 or 2, wherein n is an integer of 1 to 4.

4. An electrophotographic photosensitive member according to claim 3, wherein n is 2.

5. An electrophotographic photosensitive member according to claim 4, wherein $R_1$'s and $R_2$'s are all hydrogen atoms.

6. An electrophotographic photosensitive member according to claim 3, wherein $R_1$'s and $R_2$'s are all hydrogen atoms.

7. An electrophotographic photosensitive member according to claim 2, wherein $R_1$'s and $R_2$'s are all hydrogen atoms.

8. An electrophotographic photosensitive member according to claim 1, wherein the repeating unit is the one represented by Formula (2).

9. An electrophotographic photosensitive member according to claim 1 or 8, wherein m is an integer of 1 to 4.

10. An electrophotographic photosensitive member according to claim 9, wherein m is 2.

11. An electrophotographic photosensitive member according to claim 10, wherein $R_3$'s and $R_4$'s are all hydrogen atoms.

12. An electrophotographic photosensitive member according to claim 9, wherein $R_3$'s and $R_4$'s are all hydrogen atoms.

13. An electrophotographic photosensitive member according to claim 8, wherein $R_3$'s and $R_4$'s are all hydrogen atoms.

14. An electrophotographic photosensitive member according to claim 1, wherein the repeating unit represented by Formula (1) or (2) is in an amount of from 40 mol % to 100 mol % based on all the repeating units of the resin.

15. An electrophotographic photosensitive member according to claim 14, wherein the repeating unit represented by Formula (1) or (2) is in an amount of from 70 mol % to 100 mol % based on all the repeating units of the resin.

16. A process cartridge comprising an electrophotographic photosensitive member and at least one means selected from the group consisting of a charging means, a developing means and a cleaning means;

said electrophotographic photosensitive member and said at least one means being supported as one unit which is detachable from a main body of an electrophotographic apparatus; and said electrophotographic photosensitive member comprising a support and a photosensitive layer formed on the support, wherein;

said electrophotographic photosensitive member has a surface layer containing a resin having at least one of repeating units represented by the following Formulas (1) and (2):

(1)

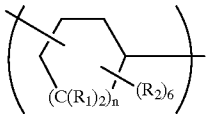

wherein n represents an integer of 0 or more; $R_1$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group; and $R_2$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group;

(2)

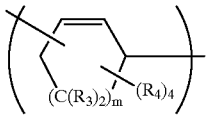

wherein m represents an integer of 0 or more; $R_3$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group; and $R_4$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group.

17. An electrophotographic apparatus comprising an electrophotographic photosensitive member, a charging means, an exposure means, a developing means and a transfer means;

said electrophotographic photosensitive member comprising a support and a photosensitive layer formed on the support, wherein;

said electrophotographic photosensitive member has a surface layer containing a resin having at least one of repeating units represented by the following Formulas (1) and (2):

(1)

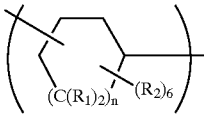

wherein n represents an integer of 0 or more; $R_1$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group; and $R_2$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group;

(2)

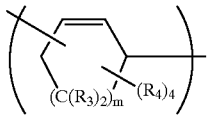

wherein m represents an integer of 0 or more; $R_3$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group; and $R_4$'s each independently represent a hydrogen atom, a halogen atom, a hydroxyl group, a substituted or unsubstituted alkyl group, a substituted or unsubstituted unsaturated aliphatic hydrocarbon group, a substituted or unsubstituted aryl group, a substituted or unsubstituted cycloalkyl group, a substituted or unsubstituted cyclodienyl group, a substituted or unsubstituted alkoxyl group, a substituted carbonyl group, an aldehyde group or a substituted or unsubstituted heterocyclic group.

* * * * *

UNITED STATES PATENT AND TRADEMARK OFFICE

CERTIFICATE OF CORRECTION

PATENT NO. : 6,110,628

DATED : August 29, 2000

INVENTOR(S) : MICHIYO SEKIYA ET AL.

It is certified that error appears in the above-identified patent and that said Letters Patent is hereby corrected as shown below:

COLUMN 4:

Line 31, "molecular" should read --a molecular--; and
Line 37, "2," should be deleted.

COLUMN 10:

Line 50, "121" should read --12I--.

COLUMN 12:

Line 61, "FIGURE," should read --Figure,--.

COLUMN 13:

Line 20, "applied, for example," should read --used, e.g.,--.

COLUMN 15:

Line 25, "made similarly" should read --made.--; and
Line 57, "made similarly" should read --made.--.

COLUMN 16:

Line 22, "was added thereto." should read --were introduced.--;
Line 24, "Then," should read --Then, a--;
Line 34, "100 molt" should read --100 mol%--;
Line 42, "made similarly" should read --made.--;
Line 53, "Evaluation" should read --An evaluation--; and
Line 63, "Evaluation was made similarly" should read --A similar evaluation was made.--

UNITED STATES PATENT AND TRADEMARK OFFICE

CERTIFICATE OF CORRECTION

PATENT NO. : 6,110,628

DATED : August 29, 2000

INVENTOR(S) : MICHIYO SEKIYA ET AL.

It is certified that error appears in the above-identified patent and that said Letters Patent is hereby corrected as shown below:

COLUMN 18:

Line 9, "Also," should read --Also, a--.

COLUMN 19:

Line 31, "made similarly." should read --made.--;
Line 46, "made similary." should read --made.--;
Line 60, "resin" should read --of the resins--; and
Line 62, "made similarly."should read --made.--.

COLUMN 20:

Line 28, "made similarly." should read --made.--
Line 47, "made similarly." should read --made.--; and
Line 66, "made similarly." should read --made.--.

COLUMN 22:

Line 8, "made similarly." should read --made.--.

COLUMN 23:

Line 16, "made similarly." should read --made.--.

COLUMN 24:

Line 9, "was" should read --were--; and
Line 37, "Evaluation" should read --An evaluation--.

COLUMN 26:

Line 21, "Evaluation" should read --An evaluation--.

UNITED STATES PATENT AND TRADEMARK OFFICE

CERTIFICATE OF CORRECTION

PATENT NO. : 6,110,628

DATED : August 29, 2000

INVENTOR(S) : MICHIYO SEKIYA ET AL.

It is certified that error appears in the above-identified patent and that said Letters Patent is hereby corrected as shown below:

COLUMN 27:

Line 29, "Evaluation" should read --An evaluation--.

COLUMN 30:

Line 38,"Evaluation" should read --An evaluation--.

COLUMN 31:

Line 6, "made similarly." should read --made.--;
Line 33, "made similarly." should read --made.--; and
Line 60, "made similarly." should read --made.--.

COLUMN 32:

Line 24, "made similarly." should read --made.--;
Line 32, "made similarly." should read --made.--;
Line 66, "made similarly." should read --made.--;

COLUMN 33:

Table 10, "Formula (1)" should read --Formula(2)--; and
Line 66, "made similarly." should read --made.--.

COLUMN 35:

Line 3, "made similarly." should read --made.--;
Line 11, "made similarly." should read --made.--;
Line 20, "made similarly." should read --made.--; and
Line 29, "made similarly." should read --made.--.

UNITED STATES PATENT AND TRADEMARK OFFICE

CERTIFICATE OF CORRECTION

PATENT NO. : 6,110,628

DATED : August 29, 2000

INVENTOR(S) : MICHIYO SEKIYA ET AL.

It is certified that error appears in the above-identified patent and that said Letters Patent is hereby corrected as shown below:

COLUMN 36:

Line 9, "made similarly." should read --made.--; and
Line 28, "made similarly." should read --made.--.

COLUMN 37:

Line 49, "Evaluation" should read --An evaluation--.

COLUMN 38:

Line 65,"Evaluation" should read --An evaluation--.

COLUMN 40:

Line 57, "Evaluation" should read --An evaluation--.

COLUMN 41:

Line 61, "made similarly," should read --made,--.

COLUMN 42:

Line 62, "Then," should read --Then, a--.

COLUMN 43:

Line 10, "made similarly." should read --made.--; and
Line 18, "made similarly." should read --made.--.

COLUMN 44:

Line 2, "made similarly." should read --made.--;
Line 16, "Evaluation" should read --An evaluation--; and
Line 30, "Evaluation" should read --An evaluation--.

UNITED STATES PATENT AND TRADEMARK OFFICE

CERTIFICATE OF CORRECTION

PATENT NO. : 6,110,628

DATED : August 29, 2000

INVENTOR(S) : MICHIYO SEKIYA ET AL.

It is certified that error appears in the above-identified patent and that said Letters Patent is hereby corrected as shown below:

COLUMN 47 & 48:

Table 17,

| " fraction* | Molar Unit | Structural fraction* | Molar unit | Structural fraction* | Molar weight | molecular (μm) | Scrape" |
|---|---|---|---|---|---|---|---|

should read --

| "Molar fraction* | Structural Unit | Molar fraction* | Structural unit | Molar fraction* | Molecular weight | scrape (μm) |
|---|---|---|---|---|---|---|

--.

NY_MAIN 150155 v 1

Signed and Sealed this

Fifteenth Day of May, 2001

*Attest:*

Nicholas P. Godici

NICHOLAS P. GODICI

*Attesting Officer*

*Acting Director of the United States Patent and Trademark Office*